United States Patent [19]

Woodard

[11] 3,979,806

[45] Sept. 14, 1976

[54] MEANS FOR POSITIONING AN EFFUSIVE STRUCTURE IN A CATHODE RAY TUBE

[75] Inventor: Harold Santford Woodard, Seneca Falls, N.Y.

[73] Assignee: GTE Sylvania Incorporated, Stamford, Conn.

[22] Filed: July 2, 1975

[21] Appl. No.: 592,645

[52] U.S. Cl. ..... 29/25.19; 29/203 H

[51] Int. Cl.[2] ..... H01J 9/02

[58] Field of Search ..... 29/25.19, 25.1, 200 R, 29/200 H, 203 R, 203 H, 203 HM; 81/3 R

[56] References Cited

UNITED STATES PATENTS 3,626,572 12/1971 Chang ..... 81/3 R

*Primary Examiner*—Richard B. Lazarus

*Attorney, Agent, or Firm*—Norman J. O'Malley; Frederick H. Rinn; Robert T. Orner

[57] ABSTRACT

A device is provided for transporting an effusive material structure through the open neck of a cathode ray tube envelope to effect positioning of the effusive structure on the frame of a screen-related apertured member oriented within the forward region of the envelope. The device includes a hand grip, a longitudinal body member having a curved portion and a head member terminally positioned thereon. The head member incorporates guide means and resilient retention means to effect a temporary sliding relationship to accommodate the clip portion of the effusive structure during the positioning procedure.

2 Claims, 5 Drawing Figures

MEANS FOR POSITIONING AN EFFUSIVE STRUCTURE IN A CATHODE RAY TUBE

BACKGROUND OF THE INVENTION

This invention relates to the orientation of effusive material structures within a cathode ray tube and more particularly to a device for retentively positioning an effusive structure within a cathode ray tube envelope.

It is conventional practice in cathode ray tubes of the type employed in television display applications, to position a container of effusive material, such as for example a getter, on the terminal portion of the electron generating assembly oriented within the neck portion of the tube envelope. An exemplary effusive structure of this type is one referenced within the art as an antenna getter, such being usually comprised of a resilient longitudinal supporting member or curved wand having a container of gettering material terminally mounted thereon. Upon insertion and orientation of the electron gun assembly within the neck portion, the forward extending getter container is positioned closely adjacent to the interior surface of the outwardly flared funnel portion of the tube envelope which is usually coated with an electrical conductive material. During process activation of getters so positioned, the effusive material emanating therefrom is deposited over a broad area of the funnel-disposed conductive coating.

In certain types of tube constructions, two or more diverse electrically related coatings are disposed in discrete areas of the funnel portion. In such instances, the dispersal of a broad area of gettering material thereover becomes a deleterious factor in that it effects electrical leakage between the conductive areas. While diffusion directive means have been fashioned and incorporated with the getter containers to control the effusion of material emanating therefrom, there are times when adequate and consistent control is difficult to achieve especially when the getter is positioned proximal to the diversely coated areas.

In another orientation, gettering means have been mounted in the forward region of the tube envelope on screen related structures, such as shadow masks or electrode members, prior to sealing of the face panel to the funnel portion of the envelope, since there was no means for installation of the getter after consummation of the panel-funnel seal. This prior-to-sealing positioning of directional getter means evidences disadvantages in that heat required for sealing of the panel to the funnel is of a temperature adversely affecting the gettering material.

OBJECTS AND SUMMARY OF THE INVENTION

It is an object of the invention to reduce the aforementioned disadvantages of the prior art. Another object is to provide an expeditious means for positioning an effusive structure in a cathode ray tube envelope subsequent to the sealing of the panel and funnel portions thereof.

These and other objects and advantages are achieved in one aspect of the invention by a device for transporting an effusive material structure through the open neck portion of a cathode ray tube envelope and subsequently effecting positioning of the effusive structure on the frame of a screen-related apertured member located within the envelope. The effusive structure includes a configurated clip means having a resilient frame engagement portion and a planar base portion.

Symmetrically affixed to the base portion thereof is one end of a longitudinal supporting member having a container of effusive material terminally oriented thereon. The device for positioning the effusive structure is comprised of a longitudinal body member having first and second opposed ends. A suitable hand-grip member is attached to the first end of the longitudinal member and a distally-related head member is positioned on the opposed second end thereof. The head member, which is formed to accommodate the temporary retention of the base portion of the effusive structure, has a leading edge formed to effect pressured contact against a portion of the clip means to accomplish retentive gripping of the clip means onto the frame portion of the screen related member, whereupon the positioning device is then manually retracted in a manner to effect sliding removal of the head member from the positioned clip means.

DETAILED DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

Figure 1:
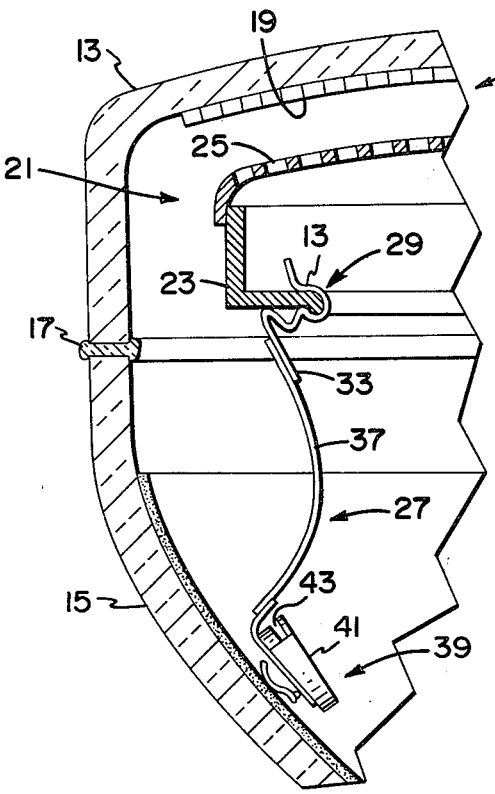
FIG. 1 is a partially sectioned view of a cathode ray tube illustrating the orientation of an effusive material structure therein.

With reference to the drawings, FIG. 1 illustrates a partially sectioned view of a cathode ray tube 11 whereof the face panel portion 13 is joined to the funnel portion 15 by a peripheral seal 17 therebetween. The panel member has a patterned cathodoluminescent screen 19 disposed on the inner surface thereof. Oriented within the confines of the panel 13, and adjacent to the screen, is a screen-related apertured member 21, as for example a shadow mask or an open-patterned electrode structure. Usually such screen-related structures are comprised of a framing means 23 to which a discretely apertured element 25 is affixed. The positioning of this screen-related structure within the panel 13 is effected by conventional means not shown.

Figure 2:
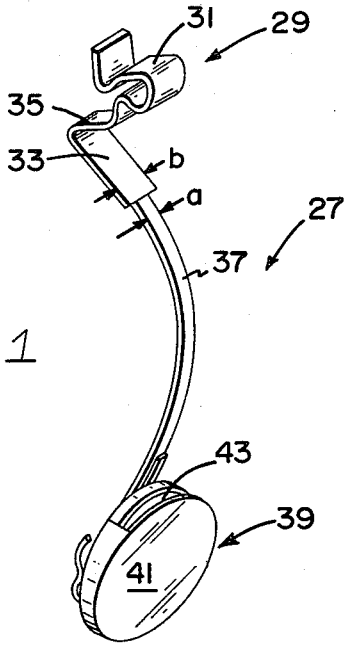
FIG. 2 is a perspective view of the effusive material structure shown in FIG. 1.

Attached to the framing means 23 is an effusive material structure 27 which is delineated in both FIGS. 1 and 2. This structure includes a configuratively formed clip means 29 which incorporates a resilient frame-engagement portion 31 and an integral substantially planar base portion 33 which extends from an acutely angled bend 35 in the configuration. Symmetrically affixed to the base portion is a longitudinal supporting member 37 having at least a portion thereof of a width *a* less than the width *b* of the base portion 33. Terminally oriented upon the supporting member is a container 39 of effusive material, wherewith there is associated a directional shielding member 41 having a defined opening 43 from which the effusion of material is emitted.

The term "effusive material" is intended to have sufficient generic breadth to include the accommodation of any vaporizable or effusive material that may be desirably diffused within the internal environment of a cathode ray tube, such as gettering or gas adsorbing substances, selected gases, and discrete metallic depositions. For purposes of example, a gettering structure will be referenced herein.

Figure 3:
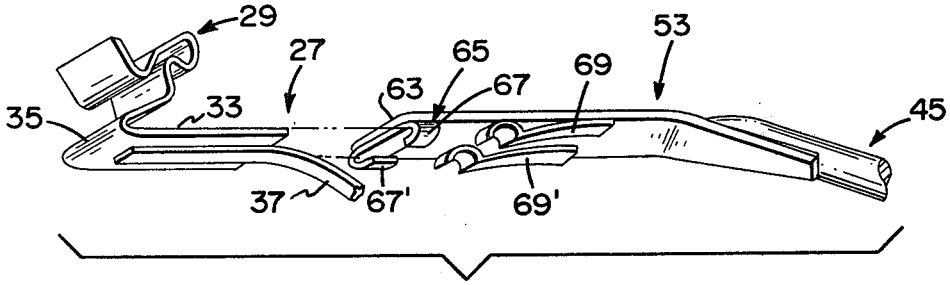
FIGS. 3 and 4 are enlarged perspective views illustrating the relationship of the clip means of the effusive material structure with the head member of the positioning device of the invention.

For a description of the invention, reference is directed to FIGS. 3, 4, and 5 wherein there is shown a device 45 for transporting an effusive getter structure 27 through the open neck 47 of a cathode ray tube envelope and subsequently effecting positioning of this structure on the frame 23 of a screen-related apertured member 21. The positioning device 45 is comprised of three basic parts or elements: a longitudinal body member 49; an associated hand grip member 51, and a head member 53 for accommodating temporary retention of the gettering structure 27. In greater detail, the longitudinal body member 49 having first and second opposed ends 55 and 57, is a substantially rigid rod-like metallic or plastic member formed in a manner whereof substantially the half 59 of the member proximal to the first end 55 is substantially straight, while the opposed half of the member 61 substantially proximal to the second end 57 has an arcuate bend therein. The hand grip member 51 is suitably attached to the first end 55 of the longitudinal member to facilitate manual control of the device. The head member 53, which is oppositely positioned with reference to the hand grip member, is formed to have a leading edge 63 whereat associated guide means 65 are located to direct the sliding placement of the clip means 29 thereon. The guide means 65 has spaced apart directing elements 67 and 67' which permit the base portion 33 of the getter structure 27 to slide therebetween, such being delineated in FIGS. 3 and 4. Proximal to the guide means 65 on the head member are a pair of spaced apart resilient retention means 69 and 69' which are oriented in a related manner to the guide means 65 in order to contact side related areas of the base portion 33 to effect temporary retention of the base portion as it is slid into position upon the head member 53. As shown, the leading edge 63 of the head member effects positioning pressure against the acutely angled bend 35 of the clip means 29 during the positioning of the clip means on the frame 23 of the apertured member.

Figure 4:
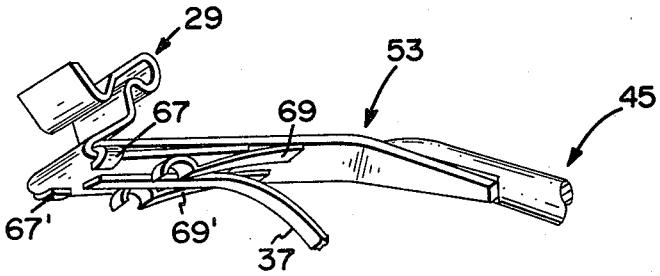
Figure 5:
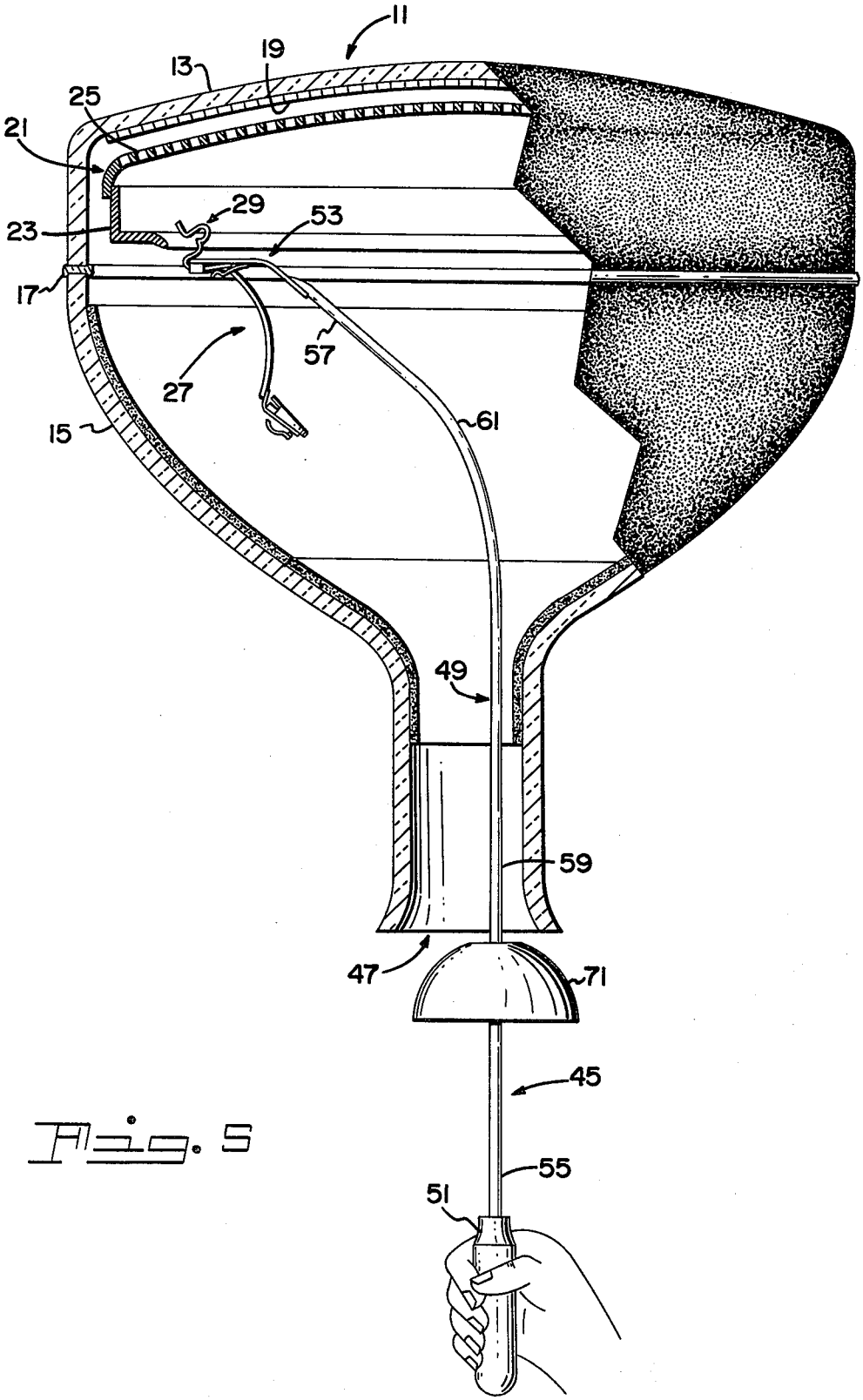
FIG. 5 is a view of a partially sectioned tube wherein the device of the invention is employed in positioning an effusive material structure on the screen-related member.

With the clip means of the gettering structure temporarily accommodated upon the head member 53 of the positioning device 45, as shown in FIG. 4, the device is manually manipulated to transport the getter structure 27 through the open neck 47 of the cathode ray tube envelope, and is thence moved into position adjacent the framing means 23 of the screen-related apertured member 21 as shown in FIG. 5. The jaw-like resilient frame engagement portion 31 of the clip means 29 is moved to effect clamping contact on the contoured edge of the framing means 23. As previously mentioned, the leading edge 63 of the head member effects positioning pressure against the acutely angled bend of the clip means 29 to consummate the attachment engagement of the clip to the framing member. The device 45 is then manually moved to effect retraction of the head member 53 to provide sliding removal from the frame-attached clip means, whereupon the device is removed through the open neck of the envelope.

To facilitate adequate control of the device, a stop member 71 is suitably positioned on the longitudinal body member 49 to prevent the head member 53, and the clip means 29 of the associated getter structure 27, from making injurious contact with the apertured element 25 of the screen-related member 21.

Thus, there is provided an expeditious means for positioning an effusive structure within the forward region of a cathode ray tube envelope subsequent to the sealing of the panel and funnel portions thereof.

While there has been shown and described what is at present considered the preferred embodiment of the invention, it will be obvious to those skilled in the art that various changes and modifications may be made therein without departing from the scope of the invention as defined by the appended claims.

What is claimed is:

1. A device for transporting an effusive structure through the open neck of a cathode ray tube envelope and subsequently effecting positioning of said structure on the frame of a screen-related aperture member located within said envelope, said effusive structure including a configuratively formed clip means having a resilient frame-engagement portion and an integral substantially planar base portion extending from an acutely angled bend thereof, said base portion having symmetrically affixed thereto one end of a longitudinal supporting member whereupon a container of effusive material is terminally oriented, said positioning device comprising:

a substantially rigid rod-like body member having first and second opposed ends, and evidencing an arcuate bend proximal to the second end thereof;

a hand grip member attached to the first end of said rod-like member;

a head member having a substantially planar surface positioned on the second end of said body member, said head member being formed to accommodate the temporary retention of the base portion of said effusive structure, said head member having a leading edge whereat shaped guide means formed as spaced apart laterally oriented directing elements are oriented on said planar surface to accept sliding engagement of said base portion whereupon the acutely angled bend thereof is seated against said leading edge, rearward of said guide means is a pair of resilient retention means oriented on said planar surface to make pressured contact with said base portion, said leading edge effecting pressured contact against the acutely angled bend of the base portion of said clip means to accomplish retentive gripping of the resilient engagement portion of said clip means onto said frame consummating affixed positioning of said effusive structure thereon; and stop means located on said body member relative to said hand grip, said stop being shaped to cooperate with said neck opening to prevent said head member from contacting the apertured portion of said screen-related member.

2. The device for positioning an effusive structure on the frame of a screen related member according to claim 1 wherein the leading edge of said head member effects positioning pressure against the acutely angled bend of said clip means during the positioning of said clip means on the frame of said apertured member.

* * * * *